US010975644B2

(12) United States Patent
da Silva et al.

(10) Patent No.: US 10,975,644 B2
(45) Date of Patent: Apr. 13, 2021

(54) INNER BARREL ASSEMBLY FOR RECOVERY OF RESERVOIR FLUIDS FROM A CORE SAMPLE

(71) Applicant: Halliburton Energy Services, Inc., Houston, TX (US)

(72) Inventors: Nuno da Silva, Brussels (BE); Olivier Mageren, Brussels (BE); Luis Enrique Quintana Martinez, Brussels (BE)

(73) Assignee: Halliburton Energy Services, Inc., Houston, TX (US)

( * ) Notice: Subject to any disclaimer, the term of this patent is extended or adjusted under 35 U.S.C. 154(b) by 49 days.

(21) Appl. No.: 16/348,049

(22) PCT Filed: Dec. 6, 2016

(86) PCT No.: PCT/US2016/065105

§ 371 (c)(1),
(2) Date: May 7, 2019

(87) PCT Pub. No.: WO2018/106218

PCT Pub. Date: Jun. 14, 2018

(65) Prior Publication Data

US 2019/0284891 A1 Sep. 19, 2019

(51) Int. Cl.
*E21B 25/00* (2006.01)
*E21B 25/08* (2006.01)

(52) U.S. Cl.
CPC ..... *E21B 25/00* (2013.01); *E21B 25/08* (2013.01)

(58) Field of Classification Search
CPC ..... E21B 25/00; E21B 25/08; E21B 25/06; E21B 25/10
See application file for complete search history.

(56) References Cited

U.S. PATENT DOCUMENTS 4,312,414 A 1/1982 Park
4,502,553 A * 3/1985 Park ..... E21B 25/06 166/228
4,787,983 A 11/1988 Difoggio et al.
(Continued)

FOREIGN PATENT DOCUMENTS

EP 1 251 240 A2 10/2002

OTHER PUBLICATIONS

International Search Report received for PCT Patent Application No. PCT/US2016/065105, dated Aug. 7, 2017; 17 pages.

*Primary Examiner* — Michael R Wills, III
(74) *Attorney, Agent, or Firm* — Thomas Rooney; Baker Botts L.L.P.

(57) ABSTRACT

The present disclosure provides a method of forming an inner barrel assembly by installing a fluid collection liner including a pre-formed porous material that is able to retain a reservoir fluid in an inner barrel to form an inner barrel assembly. It also provides an inner barrel assembly including an inner barrel and a fluid collection liner disposed in the inner barrel, the fluid collection liner comprising a plurality of sections of pre-formed porous material that are able to retain at least one reservoir fluid. It further provides an inner barrel assembly including a segment of an inner barrel isolated from a bottom hole assembly and a fluid collection liner disposed in the inner barrel, the fluid collection liner including a pre-formed porous material that is able to retain a reservoir fluid.

15 Claims, 5 Drawing Sheets

(56) References Cited

U.S. PATENT DOCUMENTS

| | | | | |
|---|---|---|---|---|
| 5,439,065 | A * | 8/1995 | Georgi | E21B 25/06 175/226 |
| 9,217,306 | B2 * | 12/2015 | Wilson | E21B 25/06 |
| 2006/0169496 | A1 | 8/2006 | Puymbroeck et al. | |
| 2012/0234607 | A1 | 9/2012 | Kinsella | |
| 2012/0261192 | A1 * | 10/2012 | Mageren | E21B 25/02 175/58 |
| 2014/0305712 | A1 | 10/2014 | Wilson et al. | |
| 2015/0176355 | A1 | 6/2015 | Trinh et al. | |
| 2016/0010401 | A1 | 1/2016 | Fulda et al. | |
| 2016/0194928 | A1 * | 7/2016 | Delmar | E21B 49/081 175/58 |
| 2016/0245030 | A1 * | 8/2016 | Uhlenberg | E21B 25/06 |

* cited by examiner

INNER BARREL ASSEMBLY FOR RECOVERY OF RESERVOIR FLUIDS FROM A CORE SAMPLE

RELATED APPLICATIONS

This application is a U.S. National Stage Application of International Application No. PCT/US2016/065105 filed Dec. 6, 2016, which designates the United States, and is incorporated herein by reference in its entirety.

TECHNICAL FIELD

The present disclosure relates generally to downhole coring operations and, more particularly, to coring tools with inner barrel assemblies for recovery of reservoir fluids from a core sample.

BACKGROUND

A coring tool for obtaining core samples from a wellbore often contains a tubular housing attached at one end to a special bit, often referred to as a core bit, and at the other end to a drill string extending through the wellbore to the surface. The tubular housing is usually referred to as an outer barrel. The outer barrel contains an inner barrel and a space, or annulus, separates the outer barrel from the inner barrel. During a typical coring operation, the core bit drills into a formation of rock and a core sample, such as a core of rock, enters and fills the inner barrel, where it is preserved. The inner barrel is then subsequently retrieved to the surface.

BRIEF DESCRIPTION OF THE DRAWINGS

For a more complete understanding of the present disclosure, its features and advantages, reference is now made to the following description, taken in conjunction with the accompanying drawings, in which.

DETAILED DESCRIPTION

Figure 1:
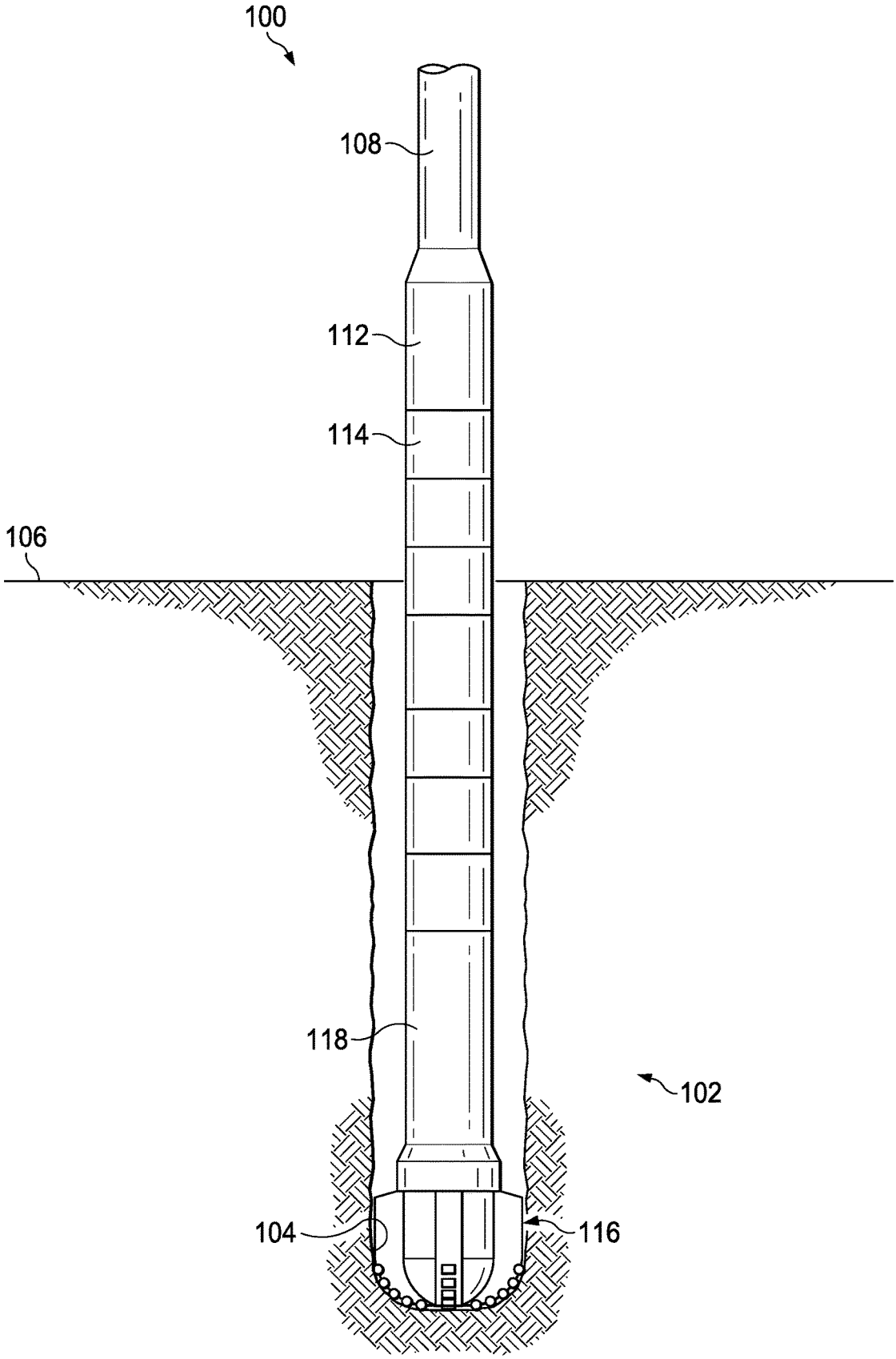
FIG. 1 is an elevation view, with portions broken away, of a drilling system at a well site.

The present disclosure relates to an inner barrel assembly of a coring tool and methods for obtaining a core sample that may recover reservoir fluids from the core sample. Reservoir fluids include liquid hydrocarbons, aqueous solutions, gasses, and any other fluids that may be included in a wellbore or an underground formation. An example of an inner barrel assembly may include a fluid collection liner disposed in an inner barrel. The inner barrel assembly may also include a receiving barrel disposed in the fluid collection liner.

The receiving barrel may include openings, such as perforations, slots, or holes, of different configurations and sizes to allow the reservoir fluids to pass through or traverse the receiving barrel and be captured or absorbed by the fluid collection liner. The configurations and sizes of the openings in the receiving barrel may be based on the properties of the reservoir fluids to be collected. For example, the configurations and sizes of the openings may be based on the viscosity, density, temperature, pressure, oil-based properties, water-based properties, or other properties of the reservoir fluids. As another example, the configurations and sizes of the openings may be based on specified reservoir fluid collection goals; the types of reservoir fluids to be collected; minimization of the collection of foreign materials such as rocks, gravel, or sand; the types and locations of porous material in the fluid collection liner; the location and size of dividers or other structures associated with the fluid collection liner; and/or any other suitable characteristic for the particular implementation. Additionally, the openings may open and close to selectively allow or prevent reservoir fluids from passing through or traversing the receiving barrel and being captured or absorbed by the fluid collection liner.

The fluid collection liner may be pre-formed or manufactured before being inserted or assembled into the inner barrel. Pre-forming the fluid collection liner facilitates higher quality fluid collection because various aspects of the manufacture are controlled. Specifically, the fluid collection liner may be formed with multiple different types and shapes of porous material. For example, one type of porous material pre-formed as a section of the fluid collection liner may be hydrophilic material while another section of the fluid collection liner may be hydrophobic material. The various types of porous material may be separated by various dividers or ridges. For example, an o-ring divider may be disposed between types of porous material to substantially prevent different types of reservoir fluids from intermingling. As another example, dividers or ridges may be used to provide mechanical support between the inner diameter of the inner barrel and the outer diameter of the receiving barrel.

The use of an inner barrel assembly with fluid collection liner sections that are pre-formed may facilitate reservoir fluid recovery and enable improved analysis of the collected reservoir fluids. Pre-forming the fluid collection liner promotes high quality and controlled manufacturing and assembly of the porous materials to collect the reservoir fluids in contrast to prior methods of forming an inner barrel liner. Additionally, analysis may be able to attribute reservoir fluids collected in the porous material to characteristics of a wellbore at given depths with precision and reliability. The inner barrel assembly may also be used with a variety of canisters and/or upper and lower barrel caps to contain and recover pressurized liquids and/or gasses. Accordingly, the disclosed systems and methods may provide higher quality reservoir fluid collection.

The present disclosure may be better understood by referring to FIGS. 1-6, where like numbers are used to indicate like and corresponding parts.

FIG. 1 is an elevation view, with portions broken away, of a drilling system 100 at a well site 106. A drilling rig (not expressly shown) may be included at the well site 106 to support and operate a drill string 108 at the well site 106 for drilling a wellbore 104. Such a drilling rig may be used to suspend the drill string 108 over the wellbore 104 as the well is drilled, and may include various types of drilling equipment normally included at such a well site, such as a rotary table, drilling fluid pumps, and drilling fluid tanks, used in drilling. Such a drilling rig may have various characteristics and features associated with a "land drilling rig," such as a rig floor. However, the present teachings are not limited to use with a land drilling rig, and may equally be used with offshore platforms, drill ships, semi-submersibles, and drilling barges.

The drill string 108 further includes a bottom hole assembly (BHA) 112. BHA 112 may be assembled from a plurality of various components that operationally assist in forming the wellbore 104 including extracting core samples from the wellbore 104. For example, the BHA 112 may include drill collars; rotary steering tools; directional drilling tools; downhole drilling motors; drilling parameter sensors for weight, torque, bend and bend direction measurements of the drill string and other vibration and rotational related sensors; hole enlargers such as reamers, stabilizers; measurement while drilling (MWD) components containing wellbore survey equipment; logging while drilling (LWD) sensors for measuring formation parameters; short-hop and long haul telemetry systems used for communication; and/or any other suitable downhole equipment. The number and different types of components included in the BHA 112 depend upon anticipated downhole drilling conditions and the type of wellbore that will be formed.

The BHA 112 may include a swivel assembly 114. The swivel assembly 114 may be an integrated component of a coring tool 102 used to isolate rotation of and torque used in rotation of a core bit 116 from other components of the coring tool 102, such as the inner barrel (as shown in FIG. 2).

The coring tool 102 (shown in more detail in FIG. 2) is coupled to the drill string 108. The coring tool 102 and the drill string 108 extend downhole from the well site 106. The coring tool 102 includes the core bit 116, which has a central opening and may include one or more blades disposed outwardly from exterior portions of a bit body of the core bit 116. The bit body may be generally curved and the one or more blades may be any suitable type of projections extending outwardly from the bit body. The blades may include one or more cutting elements disposed outwardly from exterior portions of each blade. The core bit 116 may be any of various types of fixed cutter core bits, including matrix body core bits and steel body core bits, including polycrystalline diamond cutter (PDC) core bits, including thermally stable polycrystalline diamond cutter (TSP) core bits, natural diamond, and diamond impregnated (impreg) core bits operable to extract a core sample from the wellbore 104. The core bit 116 may have many different designs, configurations, or dimensions according to the particular application of the core bit 116. The coring tool 102 further includes an outer barrel 118 and an inner barrel (discussed in detail with reference to FIG. 2) located inside the outer barrel 118.

Figure 2:
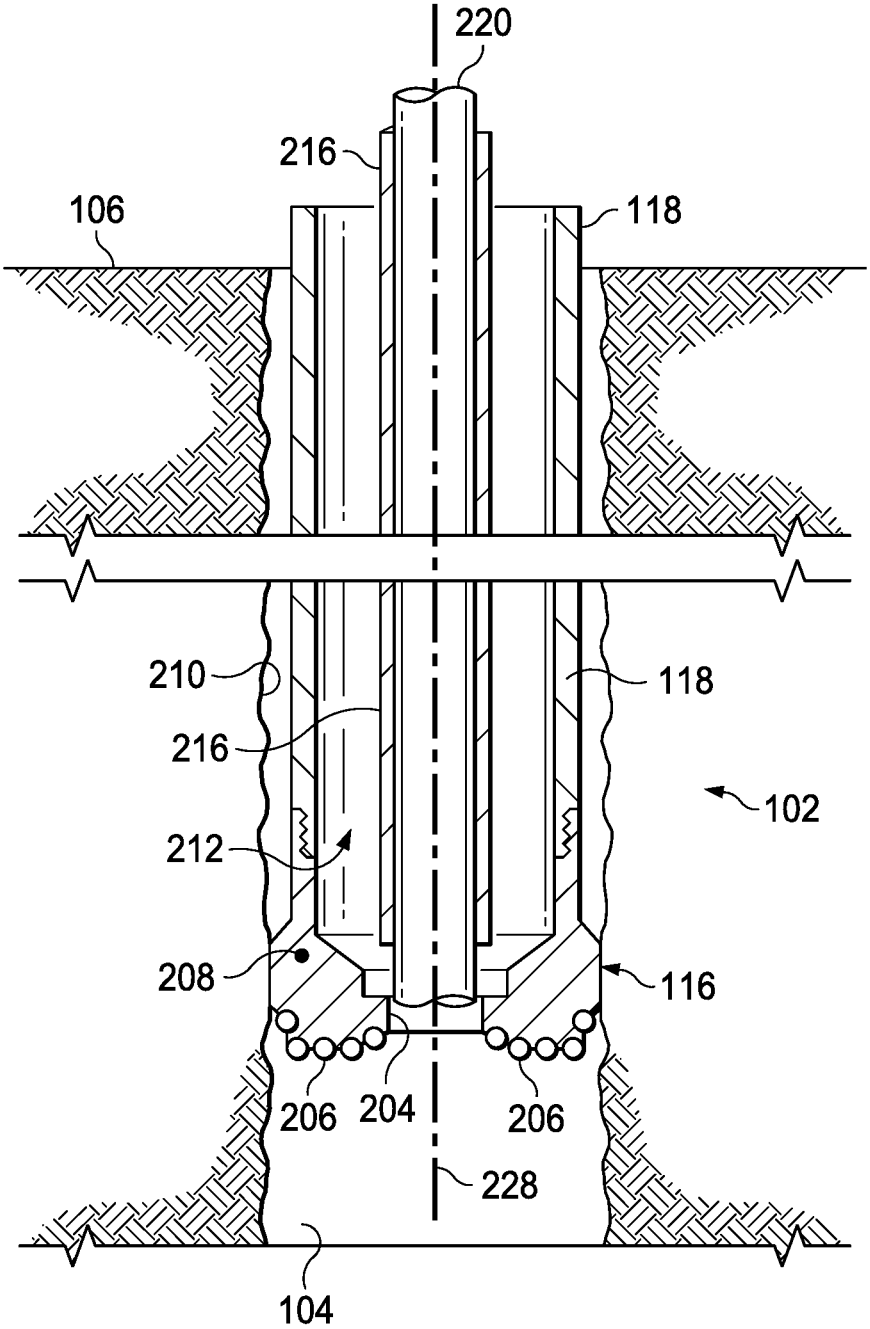
FIG. 2 is a cross-sectional view of an example coring tool, as shown in FIG. 1, used to extract and store, after extraction, a core sample from a wellbore.

FIG. 2 is a cross-sectional view of an example coring tool 102, as shown in FIG. 1, used to extract and store, after extraction, a core sample 220 from a wellbore 104. The coring tool 102 includes the core bit 116 that has a generally cylindrical body and includes a throat 204 that extends longitudinally through the core bit 116. The throat 204 of the core bit 116 may receive a core sample 220. The core bit 116 includes one or more cutting elements 206 disposed outwardly from exterior portions of a core bit body 208. A portion of each cutting element 206 may be coupled to an exterior portion of the core bit body 208. The cutting elements 206 may be any suitable device configured to cut into a formation, including but not limited to, primary cutting elements, back-up cutting elements, secondary cutting elements, or any combination thereof. By way of example and not limitation, the cutting elements 206 may be various types of cutters, compacts, buttons, inserts, and gage cutters satisfactory for use with a wide variety of core bits 116.

In operation, the core bit 116 extracts the core sample 220 from a formation such that the core sample 220 has a diameter that is approximately equal to or less than the diameter of the throat 204. The core bit 116 may be coupled to or integrated with the outer barrel 118. The outer barrel 118 is separated from one or more inner barrels 216 by an annulus 212 that may have a generally cylindrical geometry. The outer barrel 118 may include barrel stabilizers (not expressly shown) to stabilize and provide consistent standoff of the outer barrel 118 from a sidewall 210. Further, the outer barrel 118 may include additional components, such as sensors, receivers, transmitters, transceivers, sensors, calipers, and/or other electronic components that may be used in a downhole measurement system or other particular implementation. The outer barrel 118 may be coupled to and remain in contact with the well site 106 during operation.

One or more inner barrels 216 pass through the outer barrel 118. The inner barrels 216, or inner tubes, may form a tubular wall and have a generally cylindrical geometry. The inner barrels may be formed of metal, aluminum, fiberglass, plastic, or any other appropriate structural material. The tubular walls of the inner barrels 216 define a center axis 228 extending approximately through the center of the inner barrels 216. The inner barrels 216 may be housed in the outer barrel 118. In some configurations, the inner barrels 216 may extend beyond the outer barrel 118. The inner barrels 216 may be configured to slideably move uphole and downhole partially within the outer barrel 118.

The inner barrels 216 may house the core sample 220 extracted from the formation surrounding the wellbore 104. Following extraction from the wellbore 104, the core sample 220 is stored in the inner barrels 216 and later returned to the surface by retrieving the inner barrels 216 by wireline or by extraction of the whole coring assembly from the wellbore 104. Once the core sample 220 is returned to the surface, it may be severed, such as by cutting, shearing, or breaking, into multiple segments for box storage, transportation and further processing. For example, the core sample may be severed to separate the core sample in separate inner barrels 216.

During acquisition and recovery of the core sample 220, reservoir fluids may leak or flow out of the core sample 220. As discussed in further detail below, use of the inner barrels 216 with a fluid collection liner and/or a receiving barrel of the present disclosure may provide improved recovery of reservoir fluids associated with the core sample. For example, a fluid collection liner may be used to collect and retain various types of reservoir fluids until the core sample is recovered to the well site 106. Additionally, use of a receiving barrel may provide additional stability for the fluid collection liner and inner tube while allowing reservoir fluids to flow through the receiving barrel to the fluid collection liner. Using fluid collection liners with porous material that is pre-formed improves the quality of the fluid collection liner and the accuracy of analyzing the reservoir fluids. Additionally, because the porous material is pre-formed, the potential for disturbing the core sample 220 is reduced, and the rig time and associated expense necessary for injecting or creating the porous material at the well site is reduced.

Figure 3A:
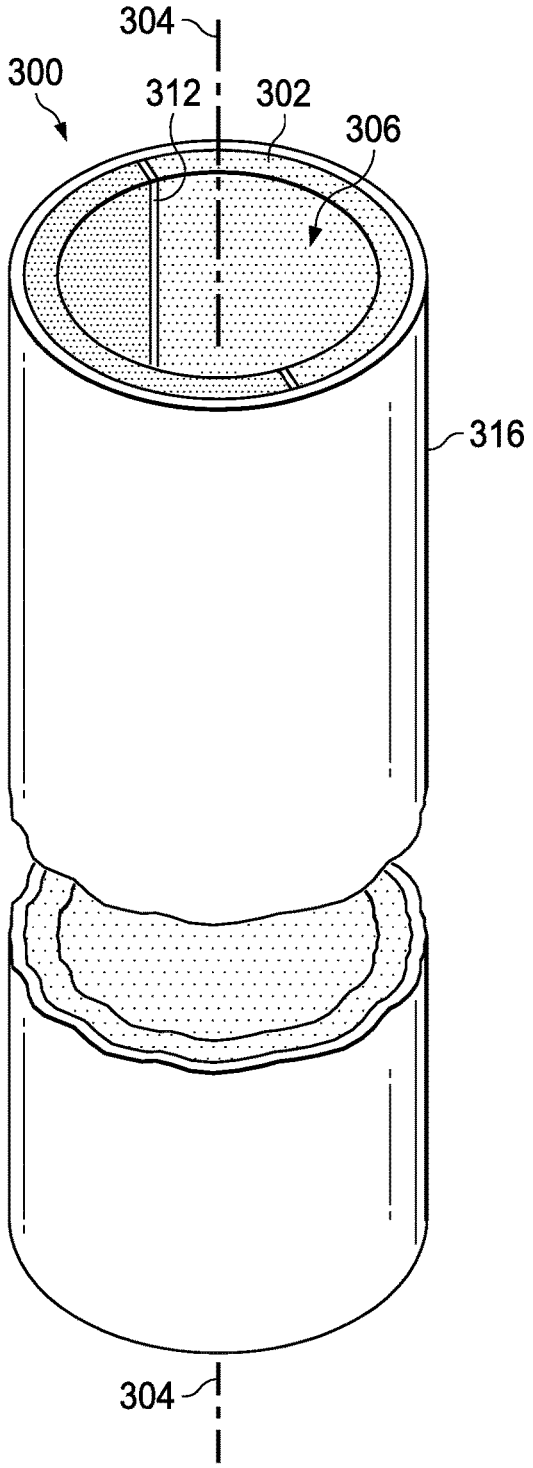
FIG. 3A is an elevation view of an exemplary inner barrel assembly including a fluid collection liner disposed in an inner barrel.

FIG. 3A is an elevation view of an exemplary inner barrel assembly 300 including a fluid collection liner 302 disposed in an inner barrel 316. The tubular walls of the inner barrel 316 and the fluid collection liner 302 define a center axis 304 extending approximately through the center of the inner barrels 316 and the fluid collection liner 302. The fluid collection liner 302 and the inner barrel 316 are co-axially aligned longitudinally along the center axis 304. The fluid collection liner 302 includes a passageway 306, or annular space, approximately through the center of the fluid collection liner 302. The passageway 306 is sized to collect and retain a core sample, e.g., core sample 220 discussed with reference to FIG. 2, during a coring operation. The thickness of the fluid collection liner 302 may be based on the inner diameter of the inner barrel 316 and the diameter of the passageway 306, which is based on the diameter of a core sample to be extracted from a wellbore. The fluid collection liner 302 may be affixed or attached to an inner surface of the inner barrel 316 using any attachment mechanism, such as by using friction/interference fit, an adhesive, a mechanical fastener, or similar mechanism appropriate for the specific implementation. Additionally, the inner barrel 316 may be the same as or similar to the inner barrel 216 shown in FIG. 2.

Figure 3B:
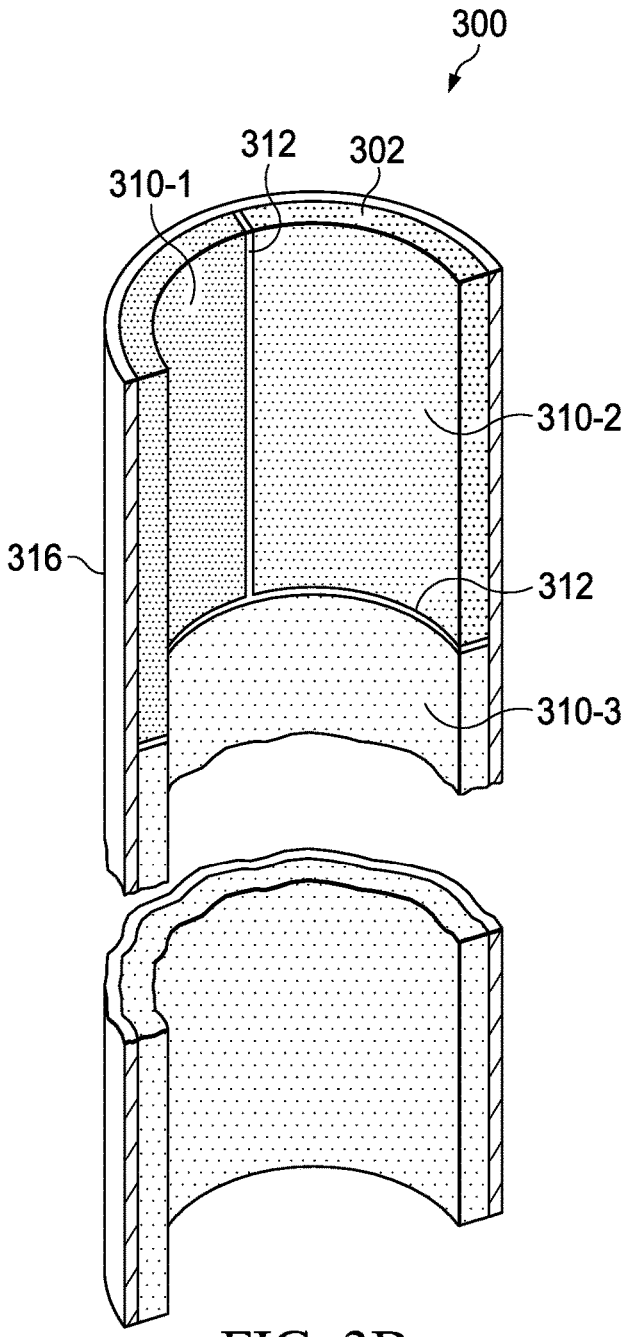
FIG. 3B is a partial cross-section view of the exemplary inner barrel assembly of FIG. 3A with portions of the inner barrel and the fluid collection liner removed.

FIG. 3B is a partial cross-section view of the exemplary inner barrel assembly 300 of FIG. 3A with portions of the inner barrel 316 and the fluid collection liner 302 removed. The fluid collection liner 302 includes porous materials 310-1, 310-2, and 310-3 (collectively "porous materials 310"). The porous materials 310 may be configured to capture, collect, absorb, and/or retain reservoir fluids during recovery of a core sample from a wellbore. Any number or types of the porous materials 310 may be used in the inner barrel assembly 300 and may be separated into sections. For example, one section of the porous material 310-1 may be a hydrophilic material, and a second section of the porous material 310-2 may be hydrophobic. As another example, one section of the porous material 310-3 may be configured to absorb a fluid with a specified viscosity, density, temperature, pressure, oil-based property, water-based property, and/or other appropriate fluid property. The sections of the porous materials 310 may be of any appropriate shape or dimensions based on the properties and/or quantity of the reservoir fluid to be captured, collected, absorbed, and/or retained. Further, the porous materials 310 may have multiple, different compositions. For example, any section of the porous materials 310 may have a sponge composition, be composed of a multitude of spheres, have a foam composition, or have any other suitable composition based on the specific implementation. Pre-forming or manufacturing sections of the porous materials 310 prior to installation may improve quality and accuracy of the porous material 310 over other methods of installing the porous materials 310 in the inner barrel 316, such as injecting methods.

One or more dividers 312 may be utilized to separate the sections of the porous material 310. The dividers 312 may be formed of a same or similar material used to form the inner barrel 316. In some cases, the dividers 312 may be formed of a different material from the inner barrel 316. For example, the dividers 312 may be constructed of metal, aluminum, fiberglass, plastic, or any other appropriate structural material. The dividers 312 may be affixed to inner barrel 316 using any attachment mechanism, such as by using friction/interference fit, an adhesive, a mechanical fastener, or similar mechanism appropriate for the specific implementation. In some cases, the dividers 312 may be integrated with the inner barrel 316. Additionally, the dividers 312 may be affixed to sections of the porous materials 310. The dividers 312 may be used to retain sections of the porous materials 310 in a defined position or location relative to the inner barrel 316.

Figure 4A:
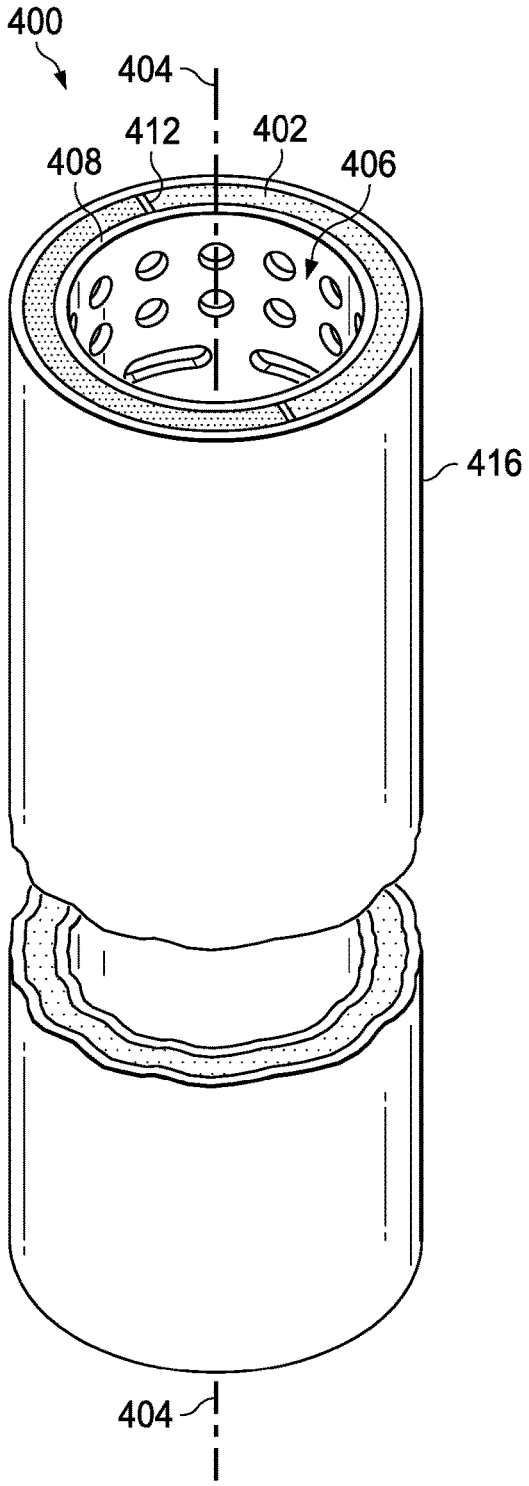
FIG. 4A is an elevation view of an exemplary inner barrel assembly including a fluid collection liner disposed in an inner barrel and a receiving barrel disposed in the fluid collection liner.

FIG. 4A is an elevation view of an exemplary inner barrel assembly 400 including a fluid collection liner 402 disposed in an inner barrel 416 and a receiving barrel 408 disposed in the fluid collection liner 402. The tubular walls of the inner barrel 416, the fluid collection liner 402, and the receiving barrel 408 define a center axis 404 extending approximately through the center of the inner barrels 416, the fluid collection liner 402, and the receiving barrel 408. The receiving barrel 408, the fluid collection liner 402, and the inner barrel 416 are co-axially aligned longitudinally along the center axis 404. The receiving barrel 408 includes a passageway 406, or annular space, approximately through the center of the receiving barrel 408. The passageway 406 is sized to collect and retain a core sample, e.g., core sample 220 discussed with reference to FIG. 2, during a coring operation. The thickness of the fluid collection liner 402 and the receiving barrel 408 may be based on the inner diameter of inner barrel 416 and the diameter of the passageway 406, which is based on the diameter of a core sample to be extracted from a wellbore. The fluid collection liner 402 may be affixed or attached to an inner surface of the inner barrel 416 using any attachment mechanism, such as by using friction/interference fit, an adhesive, a mechanical fastener, or similar mechanism appropriate for the specific implementation. Additionally, the receiving barrel 408 may be affixed to an inner surface of the fluid collection liner 402 using any attachment mechanism, such as by using friction/interference fit, an adhesive, a mechanical fastener, or similar mechanism appropriate for the specific implementation. In some cases, the receiving barrel 408 may be affixed to the dividers 412 using any attachment mechanism, such as by using friction/interference fit, an adhesive, a mechanical fastener, or similar mechanism appropriate for the specific implementation. The receiving barrel 408 may be constructed of metal, aluminum, fiberglass, plastic or any other suitable material based on the specific implementation. Additionally, the inner barrel 416 may be similar to the inner barrel 316 shown in FIG. 3A and the inner barrel 216 shown in FIG. 2. The fluid collection liner 402 may be similar to the fluid collection liner 302 shown in FIG. 3A.

Figure 4B:
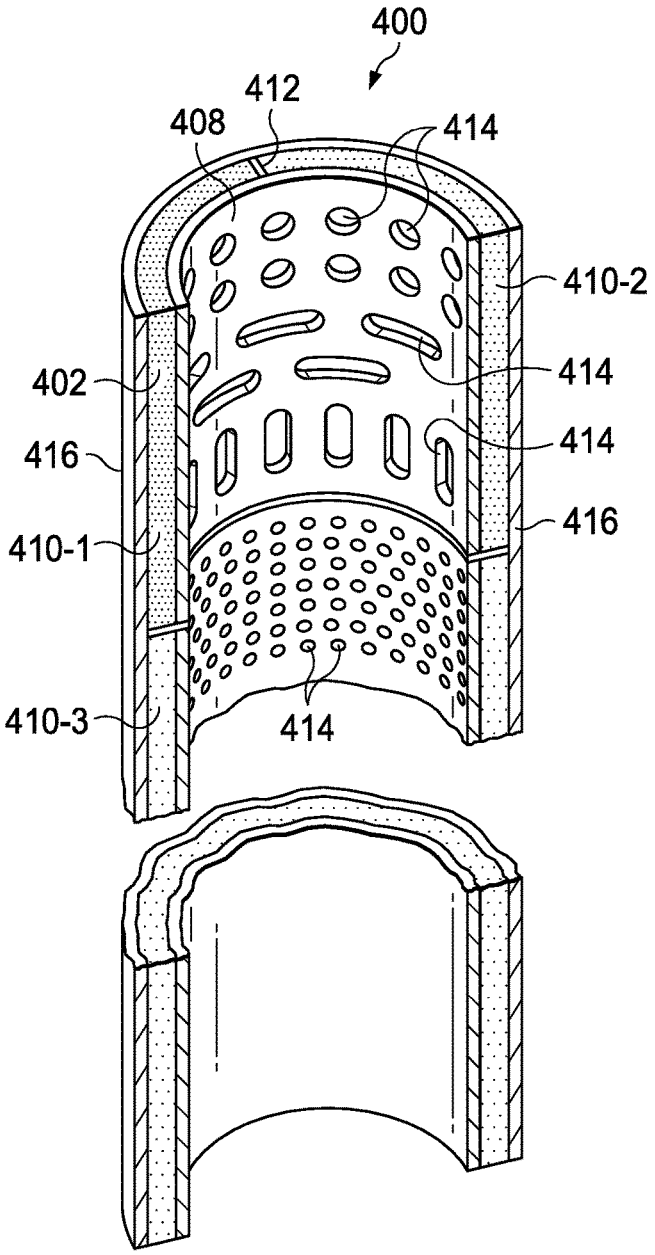
FIG. 4B is a partial cross-section view of the exemplary inner barrel assembly of FIG. 4A with portions of the inner barrel, the fluid collection liner, and the receiving barrel removed.

FIG. 4B is a partial cross-section view of the exemplary inner barrel assembly 400 of FIG. 4A with portions of the inner barrel 416, the fluid collection liner 402, and the receiving barrel 408 removed. The receiving barrel 408 may include one or more openings 414 to allow reservoir fluids from a core sample, such as the core sample 220 discussed with reference to FIG. 2, to traverse the receiving barrel 408 and be captured, collected, absorbed, and/or retained in sections of the porous material 410-1, 410-2, and 410-3 (collectively "porous materials 410") of the fluid collection liner 402. The openings 414 may be any size or configuration based on the properties of the reservoir fluids and configurations and sizes of the sections of the porous material 410 of the fluid collection liner 402. For example, the openings 414 may be circular shaped; horizontal, vertical or angled slots; small perforations; or any other suitable shape for the particular implementation. The location and dimensions of the openings 414 may be based on the properties of the reservoir fluids to be collected; specified reservoir fluid collection goals; the types of reservoir fluids to be collected; minimization of the collection of foreign materials such as rocks, gravel, or sand; the types and locations of sections of the porous materials 410 of the fluid collection liner 402; the locations and sizes of the dividers 412; and/or any other suitable characteristic for the particular implementation. As another example, the openings 414 may be formed by a screen or other suitable perforated material.

The porous materials 410 may be configured to capture, collect, absorb, and/or retain reservoir fluids during recovery of a core sample from a wellbore. Any number or types of the porous materials 410 may be used in the inner barrel assembly 400 and may be separated into sections. For example, one section of the porous material 410-1 may be a hydrophilic material, and a second section of the porous material 410-2 may be hydrophobic. As another example, one section of the porous material 410-3 may be configured to absorb a fluid with a specified viscosity, density, temperature, pressure, oil-based property, water-based property, or other appropriate fluid property. The sections of the porous materials 410 may be of any appropriate shape or dimensions based on the properties and/or quantity of the reservoir fluid to be captured, collected, absorbed, and/or retained. Further, the porous materials 410 may have multiple, different compositions. For example, any section of the porous materials 410 may have a sponge composition, be composed of a multitude of spheres, have a foam composition, or have any other suitable composition based on the specific implementation. Pre-forming or manufacturing sections of the porous materials 410 prior to installation may improve quality and accuracy of the porous material 410 over other methods of installing the porous materials 410 in the inner barrel 416, such as injecting methods.

One or more dividers 412 may be utilized to separate the sections of the porous material 410. The dividers 412 may be formed of a same or similar material used to form the inner barrel 416. In some cases, the dividers 412 may be formed of a different material from the inner barrel 416. For example, the dividers 412 may be constructed of metal, aluminum, fiberglass, plastic, or any other appropriate structural material. The dividers 412 may be affixed to inner barrel 416 using any attachment mechanism, such as by using friction/interference fit, an adhesive, a mechanical fastener, or similar mechanism appropriate for the specific implementation. In some cases, the dividers 412 may be integrated with the inner barrel 416. Additionally, the dividers 412 may be affixed to sections of the porous materials 410. The dividers 412 may be used to retain sections of the porous materials 410 in a defined position or location relative to the inner barrel 416.

Figure 4C:
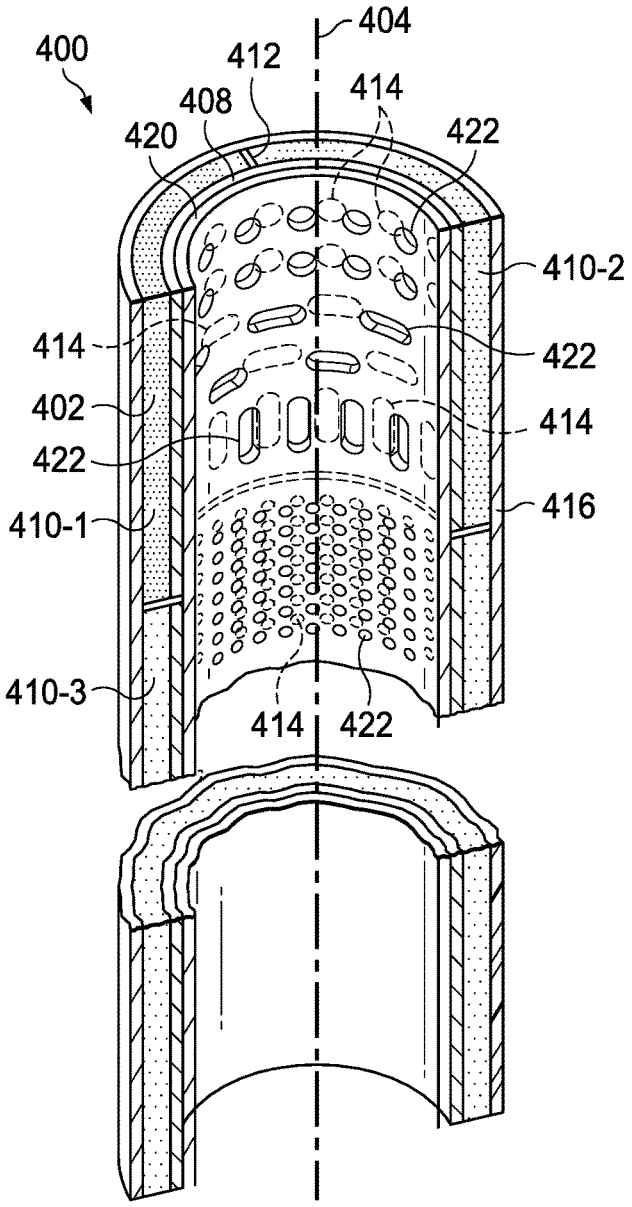
FIG. 4C is a partial cross-section view of the exemplary inner barrel assembly of FIG. 4B including an activation barrel.

FIG. 4C is a partial cross-section view of the exemplary inner barrel assembly 400 of FIG. 4B including an activation barrel 420. The activation barrel 420 may be operable to open, partially close, or fully close the openings 414. The activation barrel 420 may include activation barrel openings 422 that may be associated with openings 414. For example, the activation barrel 420 may be associated with the receiving barrel 408 and may be rotated or slid along the direction of the center axis 404 to open, partially close, or fully close the openings 414 by rotation or sliding of activation barrel openings 422. Partially closing or fully closing the openings 414 may reduce or stop the flow of reservoir fluids from the core sample to the sections of the porous materials 410 of the fluid collection liner 402. The activation barrel 420 may be operated hydraulically, electrically, manually, based on an activity, such as the breaking or severing of the core sample, and/or based on any other factor specific to the particular implementation. Additional methods of opening, partially closing, and closing the openings 414 may also be employed. For example, the partially closing or fully closing the openings 414 using the activation barrel 420 may be based on reaching a pressure threshold, temperature threshold, or other threshold related to a physical property of the environment in the wellbore or of the core sample and reservoir fluids.

Figure 5:
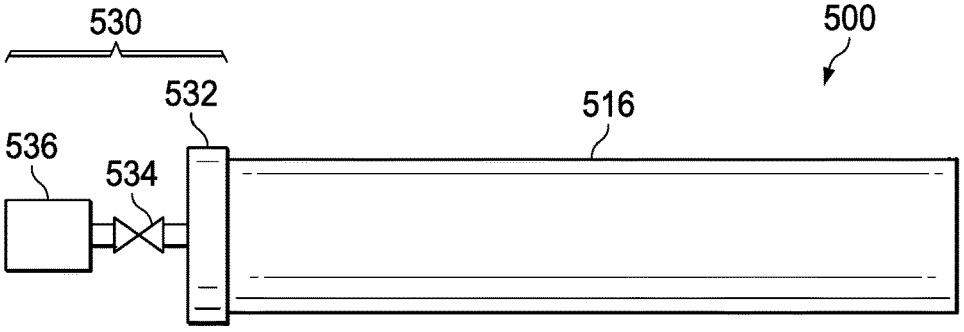
FIG. 5 is an elevation view of an exemplary inner barrel assembly including a pressurized collection system.

FIG. 5 is an elevation view of an exemplary inner barrel assembly 500 including a pressurized collection system 530. The pressurized collection system 530 may be configured to contain, collect, and/or recover pressurized liquids and/or gasses related to a core sample, such as the core sample 220 discussed with reference to FIG. 2. The pressurized collection system 530 may include one or more barrel caps 532, one or more valves 534, and/or one or more canisters 536. During a coring operation, the pressurized collection system 530 may be operable to collect pressurized fluids and/or gasses in the canister 536. Additionally, the inner barrel 516 may be similar to the inner barrel 416 shown in FIG. 4A, the inner barrel 316 shown in FIG. 3A, and the inner barrel 216 shown in FIG. 2.

During a coring operation, the core sample may be housed in the inner barrel assemblies 300, 400, or 500, which may be returned to the surface. As the inner barrel assemblies 300, 400, or 500 return to the surface with an enclosed core sample, the fluid collection liners 302 or 402 and/or the receiving barrel 408 allow for retention of the reservoir fluids during disconnection and removal of the inner barrel assemblies and separation of the extracted core into multiple core samples. The fluid collection liners 302 or 402 may be removed from the inner barrel assemblies and the collected reservoir fluids may be analyzed and processed to determine properties of the wellbore, core sample, reservoir, or any other suitable aspect of the drilling operation.

Figure 6:
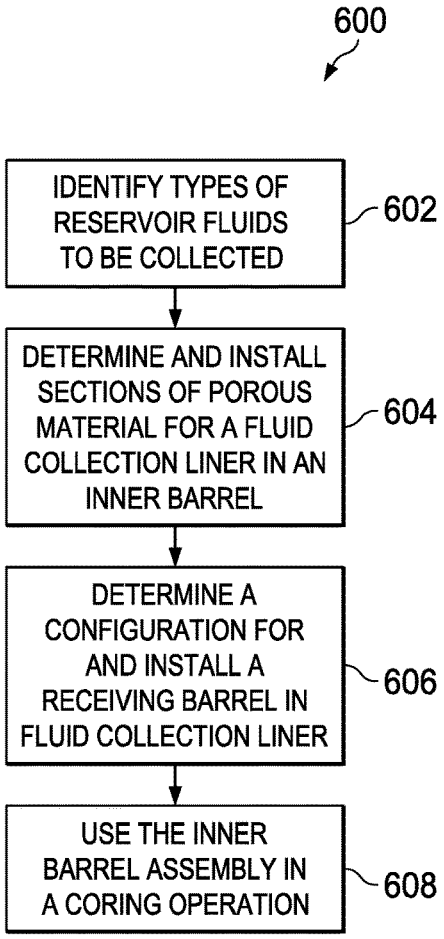
FIG. 6 is a flow chart of a method for recovery of reservoir fluids from a core sample.

FIG. 6 is a flow chart of a method for recovery of reservoir fluids from a core sample. At step 602, types of reservoir fluids to be collected during a coring operation are identified. For example, reservoir fluids may include liquid hydrocarbons, aqueous solutions, gasses, and any other fluids that may be included in a formation.

At step 604, appropriate sections of porous material to be installed in the inner barrel are determined based on the properties of the reservoir fluids to be collected, and the sections of porous material for a fluid collection liner are installed. For example, as discussed with reference to FIG. 3B, one section of the porous material 310-1 may be a hydrophilic material, and a second section of the porous material 310-2 may be hydrophobic. As another example, one section of the porous material 310-3 may be configured to absorb a fluid with a specified viscosity, density, temperature, pressure, oil-based property, water-based property, or other appropriate fluid property. The sections of the porous materials 310 may be of any appropriate shape or dimensions based on the properties and/or quantity of the reservoir fluid to be captured, collected, absorbed, and/or retained.

At step 606, an appropriate receiving barrel configuration to be installed in the fluid collection liner is determined, and the receiving barrel is installed in the fluid collection liner. For example, as discussed with reference to FIG. 4B, a receiving barrel 408 may include one or more openings 414 to allow reservoir fluids from a core sample, such as the core sample 220 discussed with reference to FIG. 2, to traverse the receiving barrel 408 and be captured, collected, absorbed, and/or retained in sections of the porous materials 410 of the fluid collection liner 402. The openings 414 may be any size or configuration based on the properties of the reservoir fluids and configurations and sizes of the sections of the porous material 410 of the fluid collection liner 402. For example, the openings 414 may be circular shaped; horizontal, vertical or angled slots; small perforations; or any other suitable shape for the particular implementation. The location and dimensions of the openings 414 may be based on the properties of the reservoir fluids to be collected; specified reservoir fluid collection goals; the types of reservoir fluids to be collected; minimization of the collection of foreign materials such as rocks, gravel, or sand; the types and locations of sections of the porous materials 410 of the fluid collection liner 402; the locations and sizes of the dividers 412; and/or any other suitable characteristic for the particular implementation. Additionally, with reference to FIG. 4C, an activation barrel 420 may be utilized that is operable to open, partially close, or fully close the openings 414 during or after the coring operations. Also, with reference to FIG. 5, a pressurized collection system 530 may be utilized that is configured to contain and recover pressurized liquids and/or gasses related to the core sample.

At step 608, the inner barrel assembly is used during a coring operation. During the coring operation, the inner barrel is lowered into an outer barrel, collects a core sample, such as a core of rock, and returns to the surface.

Embodiments disclosed herein include:

A. A method of forming an inner barrel assembly by installing a fluid collection liner including a pre-formed porous material that is able to retain a reservoir fluid in an inner barrel to form an inner barrel assembly.

B. An inner barrel assembly including an inner barrel and a fluid collection liner disposed in the inner barrel, the fluid collection liner comprising a plurality of sections of pre-formed porous material that are able to retain at least one reservoir fluid.

C. An inner barrel assembly including a segment of an inner barrel isolated from a bottom hole assembly and a fluid collection liner disposed in the inner barrel, the fluid collection liner including a pre-formed porous material that is able to retain a reservoir fluid.

Each of embodiments B and C may be formed using the method of embodiment A. Each of embodiments A, B and C may have or be formed using one or more of the following additional elements in any combinations unless clearly mutually exclusive: i) the pre-formed porous material may be selected based on at least one identified property of at least one reservoir fluid of a core sample to be collected during a coring operation using the inner barrel assembly; ii) the pre-formed porous material may include a hydrophilic material; iii) the pre-formed porous material may include a hydrophobic material; iv) installing the fluid collection liner may include attaching the fluid collection liner to an inner surface of the inner barrel; v) the method may further include coupling a pressurized collection system to an end of the inner barrel; vi) the pre-formed porous material may include a plurality of sections; vii) one of the plurality of sections may have a porosity that is different from another of the plurality of sections; viii) the method may include installing at least one divider separating at least two sections of the plurality of sections; ix) one section of the plurality of sections may have a length that is different from another section of the plurality of sections; x) each of the plurality of sections of pre-formed porous material may be selected based on at least one identified property of at least one reservoir fluid of a core sample to be collected during a coring operation; xi) at least one of the plurality of sections of pre-formed porous material may include a hydrophilic material; xii) at least one of the plurality of sections of pre-formed porous material may include a hydrophobic material; xiii) the fluid collection liner may be attached to an inner surface of the inner barrel; xiv) the inner barrel assembly may include a pressurized collection system coupled to an end of the inner barrel; xv) at least two sections of the plurality of sections of pre-formed porous material may be separated by at least one divider; xvi) the inner barrel assembly may include a receiving barrel disposed in the fluid collection liner; xvii) the receiving barrel may include a plurality of openings; xviii) the plurality of openings may be located based on the locations of the plurality of sections.

Although the present disclosure and its advantages have been described in detail, it should be understood that various changes, substitutions and alternations can be made herein without departing from the spirit and scope of the disclosure as defined by the following claims.

The invention claimed is:

1. A method of forming an inner barrel assembly, the method comprising installing a fluid collection liner including a pre-formed porous material that is able to retain a reservoir fluid in an inner barrel to form an inner barrel assembly and that includes a plurality of sections, wherein the pre-formed porous material in at least one section comprises a hydrophobic material and the pre-formed porous material in at least another section comprises a hydrophilic material.

2. The method of claim 1, further comprising coupling a pressurized collection system to an end of the inner barrel.

3. The method of claim 1, wherein one of the plurality of sections has a porosity that is different from another of the plurality of sections.

4. The method of claim 1, further comprising installing at least one divider separating at least two sections of the plurality of sections.

5. The method of claim 1, wherein one section of the plurality of sections has a length that is different from another section of the plurality of sections.

6. The method of claim 1, wherein the pre-formed porous material in at least one section has a different composition than the pre-formed porous material in at least another section.

7. The method of claim 1, wherein the pre-formed porous material in at least one section is configured to absorb a fluid a specified viscosity, density, temperature, pressure, oil-based property, or water-based property and the pre-formed porous material in at least another section is configured to absorb a fluid with a different specified viscosity, density, temperature, pressure, oil-based property, or water-based property.

8. An inner barrel assembly comprising:

an inner barrel; and a fluid collection liner disposed in the inner barrel, the fluid collection liner comprising a plurality of sections of pre-formed porous material that are able to retain at least one reservoir fluid, wherein the pre-formed porous material in at least one section comprises a hydrophobic material and the pre-formed porous material in at least another section comprises a hydrophilic material.

9. The assembly of claim 8, further comprising a pressurized collection system coupled to an end of the inner barrel.

10. The assembly of claim 8, wherein one of the plurality of sections of pre-formed porous material has a porosity that is different from another of the plurality of sections.

11. The assembly of claim 8, wherein at least two sections of the plurality of sections of pre-formed porous material are separated by at least one divider.

12. The assembly of claim 8, wherein at least one of the plurality of sections of pre-formed porous material has a length that is different from another of the plurality of sections.

13. The assembly of claim 8, further comprising a receiving barrel disposed in the fluid collection liner.

14. The assembly of claim 8, wherein the pre-formed porous material in at least one section has a different composition than the pre-formed porous material in at least another section.

15. The assembly of claim 8, where the pre-formed porous material in at least one section is configured to absorb a fluid a specified viscosity, density, temperature, pressure, oil-based property, or water-based property and the pre-formed porous material in at least another section is configured to absorb a fluid with a different specified viscosity, density, temperature, pressure, oil-based property, or water-based property.

* * * * *